United States Patent [19]

Hosokawa et al.

[11] 3,951,317

[45] Apr. 20, 1976

[54] SUBMERGED TUNDISH NOZZLE FOR CONTINUOUS CASTING

[75] Inventors: Yoshio Hosokawa; Hiroyuki Ichihashi, both of Ibaragi; Mamoru Toyota, Chiba; Kenzi Takahashi, Ibaragi, all of Japan

[73] Assignee: Sumitomo Metal Industries, Ltd., Japan

[22] Filed: Sept. 4, 1974

[21] Appl. No.: 503,065

[52] U.S. Cl. ..... 222/566; 164/281

[51] Int. Cl.[2] ..... B22D 37/00; B22D 41/08

[58] Field of Search ..... 222/566, 567; 164/281, 164/337, 273, 82; 239/505, 524, 568, 598

[56] References Cited

UNITED STATES PATENTS 3,578,064 5/1971 Mills et al. ..... 164/281

3,669,181 6/1972 Schrewe ..... 164/281

*Primary Examiner*—Stanley H. Tollberg
*Assistant Examiner*—David A. Scherbel
*Attorney, Agent, or Firm*—Watson, Cole, Grindle & Watson

[57] ABSTRACT

A submerged tundish nozzle for continuous casting wherein substantially H-shaped delivery ports are opened outward on the outer periphery of a nozzle closed at the lower end as opposed to the short side walls of a mold and, as required, said delivery ports are formed as directed a little upward or a deflecting plate of an arrowhead-shaped cross-section is set at a small distance in front of the delivery port.

Further, substantially I-shaped delivery ports may be made between those delivery ports.

1 Claim, 8 Drawing Figures

SUBMERGED TUNDISH NOZZLE FOR CONTINUOUS CASTING

This invention relates to improvements in a submerged tundish nozzle for continuous casting.

In the continuous casting of steels, there is adopted a so-called submerged nozzle injection method wherein a tundish nozzle is submerged in a mold to inject a molten steel. However, depending on the differences in the shape and structure of the nozzle to be used in such method, the molten steel will have various flowing forms within the mold.

Now, in the molten steel to be injected, a deoxidization product or nonmetallic inclusion caused by the oxidization of air is present or, for example, in a low carbon aluminum killed steel, alumina circulates within the mold together with the molten steel flow and is caught in the surface skin layer of a cast piece in the course of the coagulation to cause flaws on the surface of the rolled product.

The nonmetallic inclusion presents different caught states corresponding respectively to the differences in the flowing form and flowing velocity of the molten steel.

An object of this invention is to provide a submerged tundish nozzle which controls a molten steel flow within a mold so that a nonmetallic inclusion may be absorbed by a powder on the surface of the molten flow and may be prevented from being caught in a coagulated shell or particularly in the surface skin layer of a cast piece on the long side.

Figure 1:
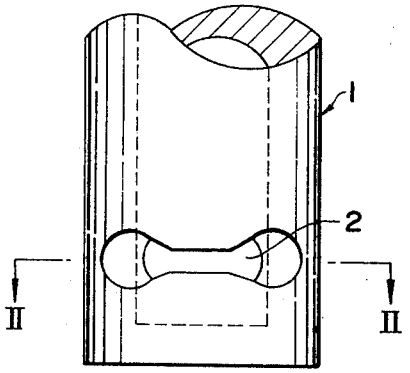
FIG. 1 is an elevation of a submerged tundish nozzle as seen from the long side of a mold according to an embodiment of this invention.
Figure 2:
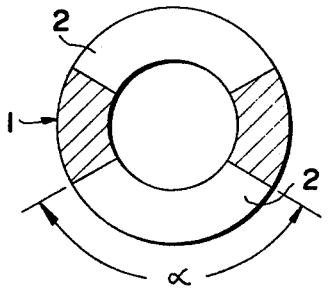
FIG. 2 is a sectioned view on line II — II in FIG. 1.

As shown in FIG. 1, substantially H-shaped delivery ports 2 are made horizontally toward long side walls 4 of a mold 3 in the lower part of a nozzle 1. More particularly, as shown in FIG. 2 which is a sectioned view on line II — II in FIG. 1, the delivery ports 2 are divergent toward the long side walls 4 of the mold 3. It is necessary to vary the divergence angle $\alpha$ depending on such conditions as the sizes of the nozzle and mold but $\alpha$ is normally 90 to 160 degrees or preferably 120 degrees.

Figure 3:
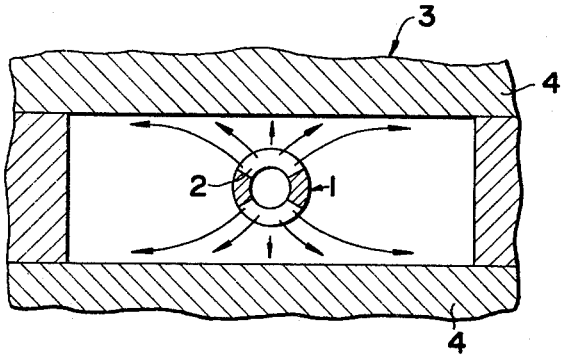
FIG. 3 is an explanatory view showing a flow of a molten steel within a mold in case the above nozzle is used.

As the structure is as described above, a molten steel delivered through the delivery ports 2 of the nozzle 1 will uniformly wash the surfaces of the coagulated layers on the long side walls 4 of the mold 3 as shown by the arrows in FIG. 3 so as to act to prevent a nonmetallic inclusion from being caught on said surfaces.

Figure 4:
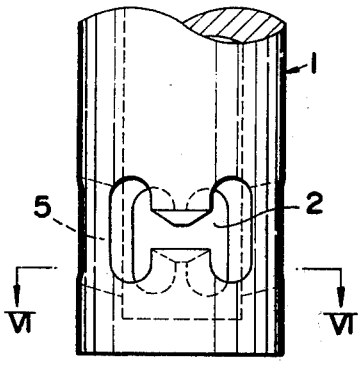
FIG. 4 is the same view as in FIG. 1 according to another embodiment of this invention.
Figure 5:
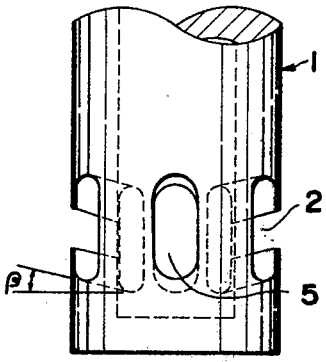
FIG. 5 is a side view of the embodiment in FIG. 4 as seen from the short side of the mold.
Figure 6:
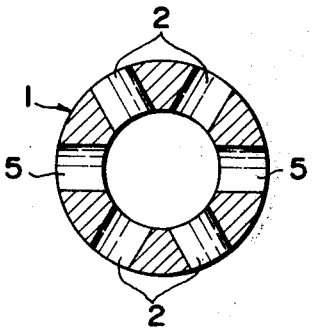
FIG. 6 is a sectioned view on line VI — VI in FIG. 4.

In the embodiment shown in FIGS. 4 to 6, as illustrated, on the side periphery of the lower submerged part of the nozzle 1, substantially H-shaped delivery ports 2 are made as directed toward the long side walls 4 and, as required, vertically long delivery ports 5 are made as directed toward the short side walls. The through hole walls of these delivery ports 2 and 5 are directed a little upward from the horizontal so that the melt surface within the mold may be waved to accelerate the reaction of the molten steel with the powder on the melt surface, that is to say, to make the nonmetallic inclusion in the molten steel easy to be absorbed by the powder.

The elevation $\beta$ of the delivery ports 2 and 5 is selected to be a proper angle depending on such conditions as the sizes of the mold and tundish nozzle 1 and the delivered amount of the molten steel but is normally 10° to 20° or preferably 15°. The divergence angle of the delivery port 2 in this embodiment is smaller than in the above mentioned embodiment and is 60° to 100° or preferably 80°.

As the submerged tundish nozzle according to this embodiment of this invention is of the above mentioned structure, the reaction of the molten steel with the powder will be accelerated and the absolute amount of the nonmetallic inclusion in the molten steel will decrease. Further, in the same manner as in the above mentioned embodiment, due to the form of the molten steel delivery port of the nozzle, the molten steel will uniformly wash the coagulated shell surface to prevent the nonmetallic inclusion from being caught on said surface.

The degrees of flaws on the surfaces of casts pieces in case a submerged tundish nozzle of this invention and a conventional two-port nozzle were used in continuously casting a low carbon aluminum killed steel were compared by a naked eye judgment to be as in Table 1 in which the numerals showing the degrees are 0 for no surface flaw, 1 for the degree of spotted flaws and 3 for the degree of flaws scattered on the entire surface.

Table 1

| | Nozzle of this invention | Conventional nozzle |
|---|---|---|
| Corner part | 1.1 | 3.0 |
| Central part | 0.1 | 3.0 |

As seen in the above table, the surface flaws scattered in the corner part and central part of the cast piece in the case of the continuous casting by using the conventional nozzle decreased to be spotted in the corner part and slightly spotted in the central part in case the nozzle of this invention was used.

Figure 7:
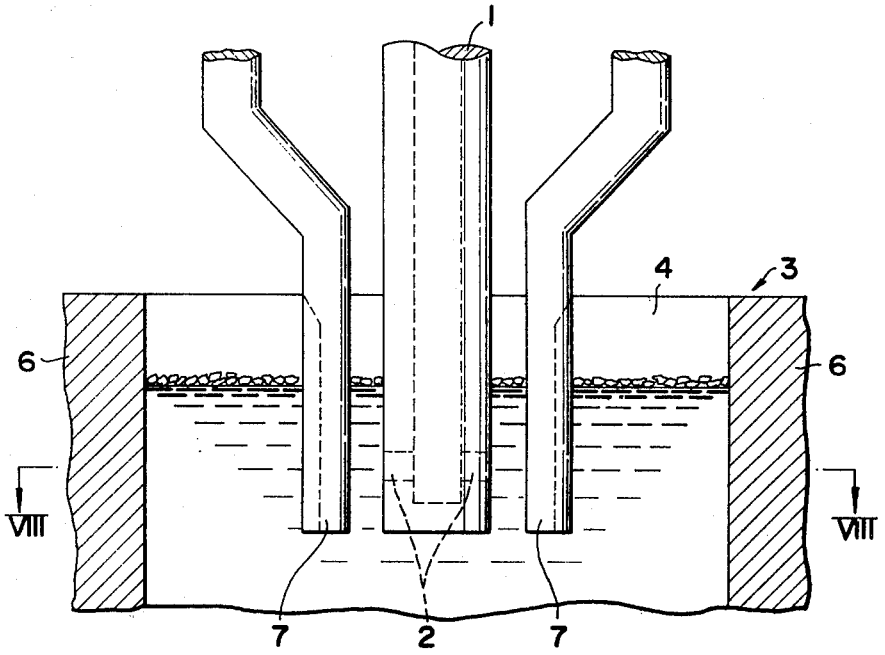
FIG. 7 is the same view as in FIG. 1 showing a further embodiment of this invention.
Figure 8:
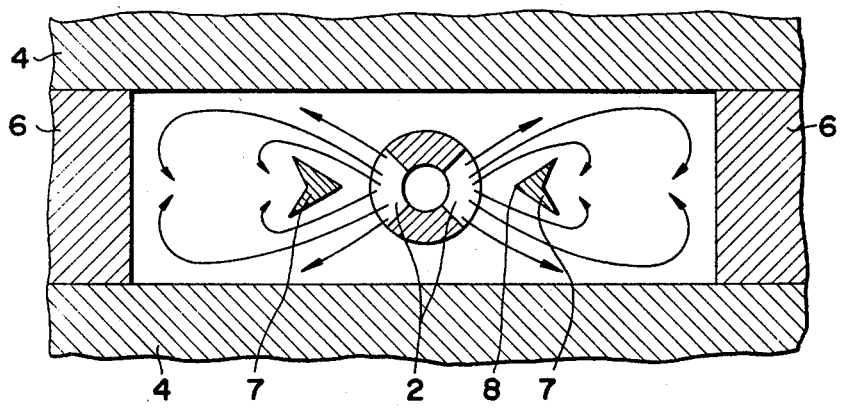
FIG. 8 is a sectioned view on line VIII — VIII in FIG. 7.

In the embodiment shown in FIGS. 7 and 8, as shown in the elevation in FIG. 7, deflecting plates 7 are provided vertically to be parallel with the nozzle 1 at small distances respectively in front of the substantially H-shaped delivery ports 2 opened toward the short side walls 6 of the mold in the lower part of the nozzle 1 and are of arrow-head-shaped cross-sections as shown in FIG. 8 which is a sectioned view on line VIII — VIII in FIG. 7. The forward tip 8 of the arrowhead is opposed to the above mentioned delivery port 2 and its back concave part is directed toward the short side wall 6 of the mold. By the way, in this embodiment, the divergence angle of the substantially H-shaped delivery port 2 is the same as in the second embodiment.

In the above structure, the molten steel delivered through the delivery ports 2 will quickly flow along the long side walls 4 of the mold 3 as shown by the arrows in FIG. 8 due to the action of the deflecting plates 7 and the nonmetallic inclusion in the molten steel will be washed away without being caught by the coagulated shell produced along the mold walls and will collect and coagulate on the back sides of the deflecting plates 7 or in the central part of the cast piece.

The comparisons by a naked eye judgment of alumina analysis amounts and slab surface flaws in a slab of a low carbon aluminum killed steel continuously cast by using the conventional two-port nozzle and a slab in the same case as in the above by using the nozzle of this invention are shown in Table 2.

Table 2

| | Contained alumina amount | Slab surface flaws |
|---|---|---|
| Conventional nozzle | 0.0015% | Scattered on the entire surface |
| Nozzle of this invention | 0.0014% | Slightly spotted |

In the above table, the absolute amounts of contained alumina were not so different but the slab surface flaws were scattered on the entire surface in case the conventional nozzle was used but were slightly spotted and evidently decreased in the case of the nozzle of this invention. This means that the nonmetallic inclusion which was alumina in this case was not caught on the slab surface but was caught in the central part.

As in the above, the submerged tundish nozzle of this invention has an excellent action of controlling the molten steel flow within the mold so that the nonmetallic inclusion in the molten steel may be positively absorbed by the powder and may be prevented from being caught in the surface skin layer of the cast piece. Therefore, if the submerged tundish nozzle of this invention is used in continuously casting a low carbon aluminum killed steel or the like, a cold-rolled steel plate high in the cleanness of the surface will be able to be obtained.

What is claimed is:

1. A submerged tundish nozzle for use with a mould of rectangular horizontal section having opposed horizontally long side walls and opposed horizontally short side walls, respectively, said nozzle having a closed lower end and having two substantially H-shaped delivery ports on the outer periphery of the nozzle and opened upwardly toward said opposed short side walls of the mould, said ports having a divergence angle of 10° to 20°, and having a deflecting plate of arrowhead-shaped horizontal cross-section set in front of each of said delivery ports.

* * * * *